US005264143A

United States Patent [19]

Boutique

[11] Patent Number: 5,264,143

[45] Date of Patent: Nov. 23, 1993

[54] STABILIZED, BLEACH CONTAINING, LIQUID DETERGENT COMPOSITIONS

[75] Inventor: Jean-Pol Boutique, Gembloux, Belgium

[73] Assignee: The Procter & Gamble Company, Cincinnati, Ohio

[21] Appl. No.: 710,609

[22] Filed: Jun. 5, 1991

[30] Foreign Application Priority Data

Jul. 27, 1990 [EP] European Pat. Off. ..... 90202049.4

[51] Int. Cl.[5] ..... C11D 3/395; C11D 7/54

[52] U.S. Cl. ..... 252/95; 252/104; 252/174.16; 252/186.27; 252/186.31; 252/DIG. 2; 252/DIG. 12; 252/DIG. 14; 252/DIG. 17

[58] Field of Search ..... 252/186.27, 186.31, 252/174.16, 95, 174.23, 174.24, DIG. 11, DIG. 2, DIG. 14, DIG. 17, 104, DIG. 12

[56] References Cited

U.S. PATENT DOCUMENTS

| | | | |
|---|---|---|---|
| 3,415,752 | 10/1968 | Browning et al. . | |
| 3,751,372 | 8/1973 | Zecher . | |
| 3,795,625 | 3/1974 | Kowalski | 252/186.27 |
| 3,923,876 | 12/1975 | Heins et al. | 252/174.16 |
| 4,111,826 | 9/1978 | Leigh et al. . | |
| 4,179,391 | 12/1979 | Kaufmann et al. . | |
| 4,207,405 | 6/1980 | Masler, III . | |
| 4,378,300 | 3/1983 | Gray | 252/186.27 |
| 4,384,970 | 5/1983 | Tourdot et al. . | |
| 4,400,367 | 8/1983 | Doetsch et al. . | |
| 4,421,664 | 12/1983 | Anderson et al. | 252/186.27 |
| 4,430,243 | 2/1984 | Bragg . | |
| 4,547,305 | 10/1985 | Cornelissen et al. . | |
| 4,581,145 | 4/1986 | Cuisia et al. . | |
| 4,618,448 | 10/1986 | Cha et al. . | |
| 4,714,565 | 12/1989 | Wevers et al. . | |
| 4,966,762 | 10/1990 | Pfeffer et al. | 252/186.27 |
| 4,970,019 | 11/1990 | Crosby et al. | 252/186.27 |
| 4,970,058 | 11/1990 | Hills et al. | 252/186.27 |

FOREIGN PATENT DOCUMENTS

| | | | |
|---|---|---|---|
| 74608 | 10/1974 | Australia | 252/174.16 |
| 0037184 | 10/1981 | European Pat. Off. . | |
| 0112801 | 7/1984 | European Pat. Off. . | |
| 0210952 | 2/1987 | European Pat. Off. . | |
| 0151884 | 11/1988 | European Pat. Off. . | |
| 0293040 | 11/1988 | European Pat. Off. . | |
| 0294904 | 12/1988 | European Pat. Off. . | |
| 0364840 | 4/1990 | European Pat. Off. . | |
| 0384515 | 8/1990 | European Pat. Off. . | |
| 3545909 | 6/1987 | Fed. Rep. of Germany . | |
| 1689 | 1/1975 | Japan | 252/174.16 |
| 2072643 | 10/1981 | United Kingdom . | |

OTHER PUBLICATIONS

Copending U.S. patent application Ser. No. 07/614,661, filed Nov. 16, 1990.

Copending U.S. patent application Ser. No. 07/629,779, filed Dec. 18, 1990.

Copending U.S. patent application Ser. No. 07/725,885, Thoen, filed Jun. 28, 1990.

Copending U.S. patent application Ser. No. 07/725,420, De Buzzaccarini et al. filed Jun. 28, 1991.

Copending U.S. patent application Ser. No. 07/420,653, filed Oct. 11, 1989.

Copending U.S. patent application Ser. No. 07/483,348, filed Feb. 20, 1990.

*Primary Examiner*—Wayne Langel

*Attorney, Agent, or Firm*—Ken K. Patel; Ronald L. Hemingway; Jacobus C. Rasser

[57] ABSTRACT

Aqueous, bleach containing, liquid detergent compositions, which are stabilized against bleach decomposition due to contamination by transition metal traces are disclosed.

The stabilizing effect is obtained by using specific diphosphonate compounds which are non-precipitating builders.

9 Claims, No Drawings

STABILIZED, BLEACH CONTAINING, LIQUID DETERGENT COMPOSITIONS

TECHNICAL FIELD

The present invention relates to aqueous liquid detergent compositions containing a solid, water soluble peroxygen compound.

Said peroxygen compounds are stabilized against decomposition due to contamination with transition metals, like iron and manganese.

BACKGROUND

It is only recently that it has become possible to formulate liquid detergent compositions containing solid, water soluble peroxygen bleaches. Such detergent compositions are described for instance in EP 0 294 904.

Under normal circumstances, the chemical stability of said peroxygen compound in such liquid detergents is satisfying, thus providing the product with good storage stability characteristics.

However, some products have shown a certain instability of the peroxygen compound, which creates a problem in terms of a sufficient storage stability for an adequate shelf life of these products.

The cause for this peroxygen instability has now been identified as a contamination of the product by transition metal traces which catalyze the decomposition of the peroxygen compound in the composition.

The contamination of the product by transition metal traces is an important problem which cannot be avoided in normal industrial practice; indeed, it has been discovered that some of the raw materials used for the manufacture of the product, are themselves carrying transition metals, at trace levels.

Further, while manufacturing, shipping, handling or stocking the product, accidental contamination may occur because of corroded pipes or containers.

A solution to this problem has been proposed in copending European patent application 90 20 0315, which describes aqueous liquid detergent composition containing a peroxygen bleach, wherein the peroxygen bleach is protected against decomposition due to transition metals by an efficient amount of hydroxyethylidene 1,1 disphosphonic acid (HEDP). In these compositions, the peroxygen compound is efficiently stabilized, but a new problem has been encountered in that HEDP tends to form large aggregates in the presence of calcium, which may precipitate. It is believed that this precipitation phenomenon may have somewhat of a detrimental effect on the whiteness maintenance of fabrics washed with HEDP-containing detergent compositions.

Also newly encountered is the fact that the use of HEDP in liquid detergent compositions appears to interfere with the stability in the finished product of enzymes which can be used in detergent compositions.

Of course, these problems can be overcome in an obvious way, e.g., by adding an enzyme stabilizing system and an anti-redeposition agent, or by compromising on the level of HEDP which is used.

The object of the invention is, as an alternative, to provide for a liquid detergent compositions which contains a solid water-soluble peroxygen bleach, which further contains a compound protecting said bleaches from decomposition due to transition metals, wherein said compound is as efficient as HEDP in protecting the bleach, but wherein said compound does not involve any risk of precipitation in the presence of calcium. It is another object of the present invention to provide a liquid detergent composition wherein said compound does not interfere with the enzyme's stability in the finished product.

SUMMARY OF THE INVENTION

This invention provides aqueous liquid detergent compositions, which comprises a solid water soluble peroxygen compound and from 0.01% to 5.0% by weight preferably from 0.5% to 1.5% by weight of a compound selected from

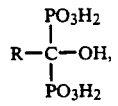

(i)

wherein R is a $C_2$ to $C_5$ alkyl or alkenyl group and;

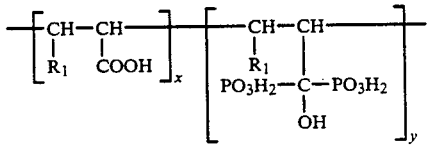

(ii)

wherein $R_1$ is H or $CO_2H$, and wherein x and y are integers, which refer to the mole proportions, and the mole ratio x:y is less than 30:1 and;

(iii) mixtures thereof.

DETAILED DESCRIPTION

The compounds which have been found to be useful for the protection of the water soluble peroxygen bleaches against decomposition due to transition metal traces, and yet do not precipitate are of the formula:

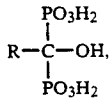

(i)

wherein R is a $C_2$ to $C_5$ alkyl or alkenyl group and;

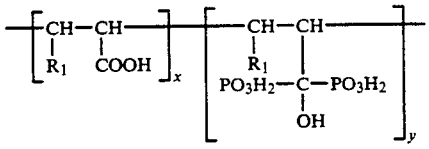

(ii)

wherein $R_1$ is H or $CO_2H$, and wherein x and y are integers which refer to the mole proportions, and the mole ratio x:y is less than 30:1, preferably less than 20:1, most preferably 4:1.

(iii) mixtures thereof.

The ratio of x:y can be determined by phosphorous nuclear magnetic resonance spectroscopy techniques which are well known to those skilled in the art.

Compounds according to formula (i) herein above can be prepared as described for instance in M. I. Kabachnik et Al., Russian Chemical Reviews 43(9), p. 733–744 (1974). These chemical reactions involve the acylation of phosphorous acid or phosphorous trichloride by carboxylic acids, their anhydrides or halides:

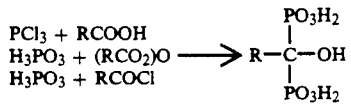

with R being a $C_2$ to $C_5$ saturated or unsaturated linear or branched hydrocarbon chain. These reactions are well known from the man skilled in the art and will therefore not be further discussed here.

Most preferred compound of formula (i) is

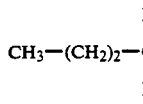

Compounds according to formula (ii) herein above, can have a molecular weight of from 1000 to 20000, preferably between 1000 and 5000, most preferably about 2000. The weight average molecular weight can be measured by the low angle scattering technique which is known to those skilled in the art (hereinafter referred to as LALLS).

Compounds according to formula (ii) herein have been extensively described among others in U.S. Pat. No. 4,207,405 to the B. F. Goodrich Company. As described in this reference, the compounds of formula (ii) can be obtained by reacting phosphorous acid or a precursor of phosphorous acid which is capable of generating phosphorous acid in an aqueous solution, e.g. $PCl_3$, in a polar organic solvent, with a water soluble carboxyl polymer. Starting materials and reaction conditions as well as proportion of the starting materials are discussed in more detail in the above reference which is available to those skilled in the art.

The compounds of formula (i) or (ii) herein or mixtures thereof are incorporated in amounts ranging from 0.01% to 5% by weight of the total composition, preferably 0.05% to 1.5%.

Synthetic anionic surfactants can be represented by the general formula $R_1SO_3M$ wherein $R_1$ represents a hydrocarbon group selected from the group consisting of straight or branched alkyl radicals containing from about 8 to about 24 carbon atoms and alkyl phenyl radicals containing from about 9 to about 15 carbon atoms in the alkyl group. M is a salt-forming cation which is typically selected from the group consisting of sodium, potassium, ammonium, and mixtures thereof.

A preferred synthetic anionic surfactant is a water-soluble salt of an alkylbenzene sulfonic acid containing from 9 to 15 carbon atoms in the alkyl group. Another preferred synthetic anionic surfactant is a water-soluble salt of an alkyl sulfate or an alkyl polyethoxylate ether sulfate wherein the alkyl group contains from about 8 to about 24, preferably from about 10 to about 18 carbon atoms and there are from about 1 to about 20, preferably from 1 to about 12 ethoxy groups. Other suitable anionic surfactants are disclosed in U.S. Pat. No. 4,170,565, Flesher et al., issued Oct. 9, 1979.

The nonionic surfactants are conventionally produced by condensing ethylene oxide with a hydrocarbon having a reactive hydrogen atom, e.g. a hydroxyl, carboxyl, or amino group, in the presence of an acidic of basic catalyst, and include compounds having the general formula $RA(CH_2CH_2O)_nH$ wherein R represents the hydrophobic moiety, A represents the group carrying the reactive hydrogen atom and n represents the average number of ethylene oxide moieties. R typically contains from about 8 to 22 carbon atoms. They can also be formed by the condensation of propylene oxide or copolymers of ethylene oxide and propylene oxide with a lower molecular weight compound. n usually varies from about 2 to about 24.

The hydrophobic moiety of the nonionic compound is preferably a primary or secondary, straight or branched, aliphatic alcohol having from about 8 to 24, preferably from about 12 to about 20 carbon atoms. A more complete disclosure of suitable nonionic surfactants can be found in U.S. Pat. No. 4,111,855. Mixtures of nonionic surfactants can be desirable.

Suitable cationic surfactants include quaternary ammonium compounds of the formula $R_1R_2R_3R_4N^+$ where $R_1$, $R_2$, and $R_3$ are methyl groups and $R_4$ is a $C_{12}$–$C_{15}$ alkyl group, or where $R_1$ is an ethyl or hydroxy ethyl group, $R_2$ and $R_3$ are methyl groups and $R_4$ is a $C_{12}$–$C_{15}$ alkyl group.

Zwitterionic surfactants include derivatives of aliphatic quaternary ammonium, phosphonium, and sulphonium compounds in which the aliphatic moiety can be a straight or branched chain and wherein one of the aliphatic substituents contains from about 8 to about 24 carbon atoms and another substituent contains, at least, an anionic water-solubilizing group. Particularly preferred zwitterionic materials are the ethoxylated ammonium sulfonates and sulfates disclosed in U.S. Pat. Nos. 3,925,262, Laughlin et al., issued Dec. 9, 1975 and 3,929,678, Laughlin et al., issued Dec. 30, 1975.

Semi-polar nonionic surfactants include water-soluble amine oxides containing one alkyl or hydroxy alkyl moiety of from about 8 to about 28 carbon atoms and two moieties selected from the group consisting of alkyl groups and hydroxy alkyl groups, containing from 1 to about 3 carbon atoms which can optionally be joined into ring structures.

Suitable anionic synthetic surface-active salts are selected from the group of sulfonates and sulfates. The like anionic detergents are well-known in the detergent arts and have found wide-spread application in commercial detergents. Preferred anionic synthetic water-soluble sulfonate of sulfate salts have in their molecular structure an alkyl radical containing from about 8 to about 22 carbon atoms.

Examples of such preferred anionic surfactant salts are the reaction products obtained by sulfating $C_8$–$C_{18}$ fatty alcohols derived from tallow and coconut oil; alkylbenzene sulfonates wherein the alkyl group contains from about 9 to 15 carbon atoms; sodium alkylglyceryl ether sulfonates; ether sulfates of fatty alcohols derived from tallow and coconut oils; coconut fatty acid monoglyceride sulfates and sulfonates; and water-soluble salts of paraffin sulfonates having from about 8 to about 22 carbon atoms in the alkyl chain. Sulfonated olefin surfactants as more fully described in e.g. U.S. Pat. No. 3,332,880 can also be used. The neutralizing cation for the anionic synthetic sulfonates and/or sulfates is represented by conventional cations which are widely used in detergent technology such as sodium and potassium.

A particularly preferred anionic synthetic surfactant component herein is represented by the water-soluble salts of an alkylbenzene sulfonic acid, preferably sodium alkylbenzene sulfonates having from about 10 to 13 carbon atoms in the alkyl group.

A preferred class of nonionic ethoxylates is represented by the condensation product of a fatty alcohol having from 12 to 15 carbon atoms and from about 2 to 10, preferably 3 to 7 moles of ethylene oxide per mole of fatty alcohol. Suitable species of this class of ethoxylates include: the condensation product of $C_{12}$–$C_{15}$ oxo-alcohols and 7 moles of ethylene oxide per mole of alcohol; the condensation product of narrow cut $C_{14}$–$C_{15}$ oxo-alcohols and 7 or 9 moles of ethylene oxide per mole of fatty(oxo)alcohol; the condensation product of a narrow cut $C_{12}$–$C_{13}$ fatty(oxo)alcohol and 6,5 moles of ethylene oxide per mole of fatty alcohol; and the condensation products of a $C_{10}$–$C_{14}$ coconut fatty alcohol with a degree of ethoxylation (moles EO/mole fatty alcohol) in the range from 5 to 8. The fatty oxo alcohols while mainly linear can have, depending upon the processing conditions and raw material olefins, a certain degree of branching, particularly short chain such as methyl branching.

A degree of branching in the range from 15% to 50% (weight %) is frequently found in commercial oxo alcohols.

Preferred nonionic ethoxylated components can also be represented by a mixture of 2 separately ethoxylated nonionic surfactants having a different degree of ethoxylation. For example, the nonionic ethoxylate surfactant containing from 3 to 7 moles of ethylene oxide per mole of hydrophobic moiety and a second ethoxylated species having from 8 to 14 moles of ethylene oxide per mole of hydrophobic moiety. A preferred nonionic ethoxylated mixture contains a lower ethoxylate which is the condensation product of a $C_{12}$–$C_{15}$ oxo-alcohol, with up to 50% (wt) branching, and from about 3 to 7 moles of ethylene oxide per mole of fatty oxo-alcohol, and a higher ethoxylate which is the condensation product of a $C_{16}$–$C_{19}$ oxo-alcohol with more than 50% (wt) branching and from about 8 to 14 moles of ethylene oxide per mole of branched oxo-alcohol.

Suitable bleaches in the present compositions are solid, water-soluble peroxygen compounds. Preferred compounds include perborates, persulfates, peroxydisulfates, perphosphates and the crystalline peroxyhydrates formed by reacting hydrogen peroxyde with sodium carbonate or urea, preferably percarbonate. Preferred peroxygen bleach compounds are sodium perborate monohydrate and sodium perborate tetrahydrate, as well as sodium percarbonate. Perborate bleaches in the present composition are preferably in the form of small particles i.e. having a diameter of from 0,1 to 20 micrometers, said particles having been formed by in situ crystallization of the perborate. The term "in situ crystallization" relates to processes whereby perborate particles are formed from larger particles or from solution, in the presence of the water-/anionic surfactant/detergent builder matrix. This term therefore encompasses processes involving chemical reactions, as when sodium perborate is formed by reacting stoichiometric amounts of hydrogen peroxide and sodium metaborate or borax. It also encompasses processes involving dissolution and recrystallization, as in the dissolution of perborate monohydrate and subsequent formation of perborate tetrahydrate. Recrystallization may also take place by allowing perborate monohydrate to take up crystal water, whereby the monohydrate directly recrystallizes into the tetrahydrate, without dissolution step.

For instance, a perborate compound, e.g., sodium perborate monohydrate, can be added to an aqueous liquid comprising the anionic surfactant and the detergent builder. The resulting slurry is stirred. During this stirring the perborate compound undergoes a process of dissolution/recrystallization. Due to the presence of the anionic surfactant and the detergent builder this dissolution/recrystallization process results in particles having the desired particle diameter. As the monohydrate is more susceptible to recrystallization, the monohydrate is preferred for this embodiment of the invention. For reasons of physical stability it is preferred that the particle size distribution is relatively narrow; i.e., it is preferred that less than 10% (wt) has a particle diameter greater than 10 micrometers.

Otherwise, a perborate compound can be formed in situ by chemical reaction. For example, sodium metaborate can be added to an aqueous liquid comprising the anionic surfactant and the detergent builder. Then a stoichiometric amount of hydrogen peroxide is added while stirring. Stirring is continued until the reaction is complete.

Instead of metaborate, other borate compounds, including e.g., borax and boric acid can be used. If borax is used as the boron compound, a stoichiometric amount of a base, e.g. sodium hydroxide, is added to ensure reaction of the borax to metaborate. The process then proceeds as described hereinabove for metaborate conversion. Instead of hydrogen peroxide, other peroxides may be used (e.g., sodium peroxide), as known in the art.

Preferred liquid detergent compositions contain, in addition to water, a water-miscible organic solvent. The solvent reduces the solubility of the solid water-soluble peroxygen bleach in the liquid phase and thereby enhances the chemical stability of the composition.

It is not necessary that the organic solvent be fully miscible with water, provided that enough of the solvent mixes with the water of the composition to affect the solubility of the solid water-soluble peroxygen bleach in the liquid phase.

The water-miscible organic solvent must, of course be compatible with the solid water-soluble peroxygen compound at the pH that is used.

Examples of suitable water-miscible organic solvents include the lower aliphatic monoalcohols, and ethers of diethylene glycol and lower monoaliphatic monoalcohols. Preferred solvents are ethanol, iso-propanol, 1-methoxy, 2-propanol, ethyldiglycolether and butyldiglycolether.

When sodium perborate is used, polyalcohols having vicinal hydroxy groups (e.g. 1,2-propanediol and glycerol) are less desirable, and the preferred solvent will then be ethanol.

The compositions according to the present invention can also contain detergent enzymes; suitable enzymes include detergent proteases, amylases, lipases, cellulases and mixtures thereof. Preferred enzymes are high alkaline proteases e.g. Maxacal (R), Savinase (R) and Maxapem (R). Silicone-coated enzymes, as described in EP-A-0238216 can also be used.

Preferred compositions herein optionally contain as a builder a fatty acid component. Preferably, however, the amount of fatty acid is less than 5% by weight of the composition, more preferably less than 4%. Preferred saturated fatty acids have from 10 to 16, more preferably 12 to 14 carbon atoms. Preferred unsaturated fatty acids are oleic acid and palmitoleic acid.

Preferred compositions contain an inorganic or organic builder. Examples of inorganic builders include the phosphorous-based builders, e.g., sodium tripolyphosphate, sodium pyrophosphate, and aluminosilicates (zeolites).

Examples of organic builders are represented by polyacids such as citric acid, nitrilotriacetic acid, and mixtures of tartrate monosuccinate with tartrate disuccinate. Preferred builders for use herein are citric acid and alk(en)yl-substituted succinic acid compounds, wherein alk(en)yl contains from 10 to 16 carbon atoms. An example of this group of compounds is dodecenyl succinic acid. Polymeric carboxylate builders inclusive of polyacrylates, polyhydroxy acrylates and polyacrylates/-polymaleates copolymers can also be used.

The compositions herein can contain a series of further optional ingredients which are mostly used in additive levels, usually below about 5%. Examples of the like additives include: suds regulants, opacifiers, agents to improve the machine compatibility in relation to enamel-coated surfaces, bactericides, dyes, perfumes, brighteners and the like.

In addition to the peroxygen stabilizing compounds, the preferred liquid compositions herein may further contain other chelants at a level from 0,05% to 5%.

These chelants include polyaminocarboxylates such as ethylenediaminotetracetic acid, diethylenetriaminopentacetic acid, ethylenediamino disuccinic acid or the water-soluble alkali metals thereof. Other additives include organo-phosphonic acids; particularly preferred are ethylenediamine tetra(methylenephosphonic acid), hexamethylenediamine tetra(methylenephosphonic acid), diethylenetriamine penta(methylenephosphonic acid) and aminetri(methylenephosphonic acid).

Bleach stabilizers such as ascorbic acid, dipicolinic acid, sodium stannates and 8-hydroxyquinoline can also be included in these compositions, at levels from 0.01% to 1%.

The beneficial utilization of the claimed compositions under various usage conditions can require the utilization of a suds regulant. While generally all detergent suds regulants can be utilized preferred for use herein are alkylated polysiloxanes such as dimethylpolysiloxane also frequently termed silicones. The silicones are frequently used in a level not exceeding 1.5%, most preferably from 0.05% to 1.0%.

It can also be desirable to utilize opacifiers in as much as they contribute to create a uniform appearance of the concentrated liquid detergent compositions. Examples of suitable opacifiers include: polystyrene commercially known as LYTRON 621 manufactured by MONSANTO CHEMICAL CORPORATION. The opacifiers are frequently used in an amount from 0.3% to 1.5%.

The liquid detergent compositions of this invention can further comprise an agent to improve the washing machine compatibility, particularly in relation to enamel-coated surfaces.

It can further be desirable to add from 0.1% to 5% of known antiredeposition and/or compatibilizing agents. Examples of the like additives include: sodium carboxymethylcellulose; hydroxy-$C_{1-6}$-alkylcellulose; polycarboxylic homo- or copolymeric ingredients, such as: polymaleic acid; a copolymer of maleic anhydride and methylvinylether in a molar ratio of 2:1 to 1:2; and a copolymer of an ethylenically unsaturated monocarboxylic acid monomer, having not more than 5, preferably 3 or 4 carbon atoms, for example (meth)-acrylic acid, and an ethylenically unsaturated dicarboxylic acid monomer having not more than 6, preferably 4 carbon atoms, whereby the molar ratio of the monomers is in the range from 1:4 to 4:1, said copolymer being described in more detail in European Patent Application 0 066 915, filed May 17, 1982.

The compositions according to the invention have a pH at room temperature of at least 8.5, more preferably at least 9.0, most preferably at least 9.5.

EXAMPLES

EXAMPLE I

A polymer according to formula (ii) is synthetical as follows: 125.0 grams of polyacrylic acid (1.44 moles, average molecular weight of 2100 as determined by LALLS), 25.9 grams of distilled water (1.44 moles), and 300.0 grams of sulfolane (tetramethylene sulfone) were mixed in a two (2) liter, round-bottom flask. This solution was stirred at 45° C. until the polyacrylic acid was dissolved. Next, 125.6 milliliters of $PCl_3$ (197.76 grams, 1.44 moles) were dripped into the solution with continual stirring over a period of approximately one (1) hour. Liberated HCl was removed from the flask with an argon purge. The solution was heated to 100° C. by placing the flask in an oil bath and maintained at that temperature for two (2) hours before allowing the solution to cool to room temperature. Once at room temperature, 600 milliliters of $CHCl_3$ were poured into the flask which caused a yellow solid precipitate to fall out of solution. The precipitate was collected by vacuum filtration and washed with $CHCl_3$ five times, with 250 milliliter of $CHCl_3$ per wash. Residual $CHCl_3$ was removed in vacuum, the precipitate was redissolved in 500 milliliters of distilled water, and the aqueous solution was refluxed at 100° C. for 18 hours to produce crude geminal diphosphonate polymer product. The aqueous solution containing the crude product was concentrated to about 200 milliliters under vacuum at 50° C., then 1.2 liters of acetone were added. The oily geminal diphosphonate polymer was recovered by decantation.

The precipitation procedure was carried out an additional four times, to produce 72 grams of a compound according to formula (ii). Examination of the product by $p^{31}$NMR analysis indicated that 43 mole % of the phosphorous in the product was present as hydroxydiphosphonic acid. The product contained 12.28 wt. % total phosphorous. The mole ratio of x:y was calculated to be about 4.0.

EXAMPLES II THROUGH XI

The following examples illustrate compositions according to the present invention. The compositions are obtained by mixing the listed ingredients in the listed proportions.

| | II | III | IV | V | VI |
|---|---|---|---|---|---|
| Na $C_{12}$–$C_{14}$ sulfate | — | — | — | — | — |
| Linear alkyl benzene sulphonate | 8.5 | 8.5 | 8.5 | 8.5 | 8.5 |
| Tallow alkyl sulfate | — | — | — | — | — |
| Condensation product of 1 mole of oxoalcohol with 5 moles of ethylene oxide | 7.0 | 7.0 | 7.0 | 7.0 | 7.0 |
| Condensation product of 1 mole of oxoalcohol with 3 moles of ethylene oxide | — | — | — | — | — |
| $C_{12}$–$C_{14}$(2-hydroxyethyl) dimethyl ammonium chloride | 0.6 | 0.6 | 0.6 | 0.6 | 0.6 |
| Dodecenyl succinic acid | 10.5 | 10.5 | 10.5 | 10.5 | 10.5 |
| Tetradecenyl/Dodecenyl succinic | — | — | — | — | — |

-continued

| | | | | | |
|---|---|---|---|---|---|
| acid | | | | | |
| Copolymer maleic acid/acrylic acid | — | — | — | — | — |
| Citric acid monohydrate | 3.0 | 3.0 | 3.0 | 3.0 | 0.3 |
| Na perborate monohydrate | 14.5 | 14.5 | 14.5 | 14.5 | 14.5 |
| Na perborate tetrahydrate | — | — | — | — | — |
| Ethanol | 10.0 | 10.0 | 10.0 | 10.0 | 10.0 |
| NaOH (up to pH) | 10.0 | 10.0 | 10.0 | 10.0 | 10.0 |
| Na formate | 1.5 | 1.5 | 1.5 | 1.5 | 1.5 |
| Na acetate trihydrate | 4.0 | 4.0 | 4.0 | 4.0 | 4.0 |
| Silicone coated savinase R (16KNPU/g) | 0.3 | 0.3 | 0.3 | 0.3 | 0.3 |
| Maxapem R (50 mg/g active) | — | — | — | — | — |
| Hydroxybutylidene 1,1 diphosphonic acid | 0.7 | — | — | 0.3 | — |
| hydroxyhexylidene 1,1 diphosphonic acid | — | 0.7 | — | — | 0.4 |
| Compound of example 1 | — | — | 0.7 | — | — |
| Diethylene triamine penta (methylene phosphonic acid) | — | — | — | 0.7 | 0.5 |
| Water and minors | up to 100% | | | | |

| | VII | VIII | IX | X | XI |
|---|---|---|---|---|---|
| Na $C_{12}$-$C_{14}$ sulfate | — | — | — | — | 8.0 |
| Linear alkyl benzene sulphonate | 8.5 | 8.5 | 8.5 | 9.5 | 0 |
| Tallow alkyl sulfate | — | — | — | 2.0 | 2.0 |
| Condensation product of 1 mole of oxoalcohol with 5 moles of ethylene oxide | 7.0 | 7.0 | 7.0 | — | — |
| Condensation product of 1 mole of oxoalcohol with 3 moles of ethylene oxide | — | — | — | 4.5 | 5.0 |
| $C_{12}$-$C_{14}$(2-hydroxyethyl) dimethyl ammonium chloride | 0.6 | 0.6 | 0.6 | — | — |
| Dodecenyl succinic acid | 10.5 | 10.5 | 10.5 | — | — |
| Tetradecenyl/Dodecenyl succinic acid | — | — | — | 8.0 | 8.0 |
| Copolymer maleic acid/acrylic acid | — | — | — | 1.4 | 1.5 |
| Citric acid monohydrate | 3.0 | 3.0 | 3.0 | 2.6 | 3.0 |
| Na perborate monohydrate | 14.5 | 14.5 | 14.5 | 0 | 15.0 |
| Na perborate tetrahydrate | — | — | — | 23.0 | — |
| Ethanol | 10.0 | 10.0 | 10.0 | 9.0 | 9.0 |
| NaOH (up to pH) | 10.0 | 10.0 | 10.0 | 10.0 | 10.0 |
| Na formate | 1.5 | 1.5 | 1.5 | 1.5 | 1.0 |
| Na acetate trihydrate | 4.0 | 4.0 | 4.0 | 3.0 | 2.0 |
| Silicone coated savinase R (16KNPU/g) | 0.3 | 0.3 | 0.3 | — | 0.3 |
| Maxapem R (50 mg/g active) | — | — | — | 0.3 | — |
| Hydroxybutylidene 1,1 diphosphonic acid | — | 0.7 | — | 0.4 | — |
| hydroxyhexylidene 1,1 diphosphonic acid | — | — | 0.8 | — | — |
| Compound of example 1 | 1.4 | — | — | 0.5 | 0.5 |
| Diethylene triamine penta (methylene phosphonic acid) | 0.2 | — | — | 0 | 1 |
| Water and minors | up to 100% | | | | |

I claim:

1. An aqueous liquid detergent composition comprising a solid, water soluble peroxygen bleach selected from the group consisting of salts of perborates and percarbonates, characterized in that it further contains from 0.01% to 5% by weight of a compound selected from the group consisting of

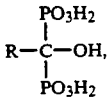

(i)

wherein R is a $C_2$ to $C_5$ alkyl or alkenyl group;

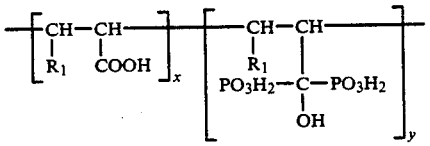

(ii)

wherein $R_1$ is H or $CO_2H$, and, wherein x and y are integers which refer to the mole proportions, and the mole ratio x:y is less than 30:1; and (iii) mixtures thereof; said composition further comprising an enzyme.

2. A composition according to claim 1 wherein said compound is

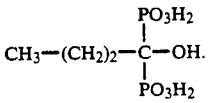

3. A composition according to claim 1 wherein the compound is of the formula (ii) and the ratio of x:y is 4:1.

4. A composition according to claim 3 wherein said compound is of the formula (ii), and said compound has a molecular weight of from 1000 to 5000.

5. A composition according to claim 4 wherein said compound has a molecular weight of 2000.

6. A composition according to claim 1 characterized in that it further comprises diethylene triamine penta (methylene phosphonic acid).

7. A composition according to claim 1 characterized in that it contains a water-miscible organic solvent.

8. A composition according to claim 7, characterized in that the water miscible organic solvent is ethanol.

9. A composition according to claim 1 having a pH of at least 9.

* * * * *